US006712139B1

(12) United States Patent
Al-Mahrous

(10) Patent No.: US 6,712,139 B1
(45) Date of Patent: Mar. 30, 2004

(54) METHOD OF WELL CASING CATHODIC PROTECTION OPTIMIZATION USING THE DRILL STEM DATA

(75) Inventor: Husain M. Al-Mahrous, Qatif - Al-Majidiyah (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 10/253,056

(22) Filed: Sep. 24, 2002

(51) Int. Cl.[7] ..... E21B 47/00; G01V 3/04

(52) U.S. Cl. ..... 166/250.05; 166/250.01; 73/152.46; 324/348; 324/356

(58) Field of Search ..... 166/250.01, 250.05, 166/254.1, 254.2; 73/152.43, 152.46, 152.07, 152.03; 324/323, 348, 351, 354, 355, 356, 357, 368, 369

(56) References Cited

U.S. PATENT DOCUMENTS 1,927,664 A * 9/1933 Karcher ..... 175/182
2,085,664 A * 6/1937 Karcher ..... 175/182
2,153,802 A * 4/1939 Jakosky ..... 175/182
RE21,102 E * 5/1939 Jakosky ..... 175/182
2,247,417 A * 7/1941 Silerman ..... 175/182
2,249,769 A * 7/1941 Leonardon ..... 175/182
2,364,957 A * 12/1944 Douglas ..... 175/182
2,557,168 A * 6/1951 Arps ..... 175/182
2,875,142 A * 2/1959 Landers ..... 204/147
2,917,704 A * 12/1959 Arps ..... 324/1
3,115,942 A * 12/1963 Arps ..... 175/50
3,999,121 A * 12/1976 Taylor, Jr. ..... 324/323
4,438,391 A * 3/1984 Rog et al. ..... 324/71.1
4,578,675 A * 3/1986 MacLeod ..... 340/855
4,625,173 A * 11/1986 Wisler et al. ..... 324/351
4,630,243 A * 12/1986 MacLeod ..... 367/82
4,786,874 A * 11/1988 Grosso et al. ..... 340/853.4
4,794,322 A * 12/1988 Davies ..... 324/347
4,837,518 A * 6/1989 Gard et al. ..... 324/368
4,942,361 A * 7/1990 Gassst ..... 324/360
5,045,795 A * 9/1991 Gianzero et al. ..... 324/342
5,187,440 A * 2/1993 Vail, III ..... 324/372
5,223,794 A * 6/1993 Vail, III ..... 324/368
5,442,294 A * 8/1995 Rorden ..... 324/339
5,510,712 A * 4/1996 Sezginer et al. ..... 324/368
5,533,572 A * 7/1996 Brady et al. ..... 166/250.05
6,114,972 A * 9/2000 Smith ..... 340/854.6
6,351,129 B1 * 2/2002 Gounot ..... 324/368
6,600,321 B2 * 7/2003 Evans ..... 324/369

* cited by examiner

*Primary Examiner*—David Bagnell
*Assistant Examiner*—Daniel P Stephenson
(74) *Attorney, Agent, or Firm*—Abelman, Frayne & Schwab

(57) ABSTRACT

A method of cathodic current optimization measures drill stem resistances along a well hole being drilled, correlates the drill stem resistances to respective types of underground formations at corresponding positions along the well hole, predicts a respective position of at least one anodic area on a well casing to be installed and determines an amount of cathodic current to be applied thereto.

10 Claims, 6 Drawing Sheets

METHOD OF WELL CASING CATHODIC PROTECTION OPTIMIZATION USING THE DRILL STEM DATA

FIELD OF THE INVENTION

This invention relates to oil/gas field drilling, and more particularly to an improved method of identifying the anodic and cathodic areas along a well casing.

BACKGROUND OF THE INVENTION

The underground casings of oil and gas wells are subject to long-line and localized corrosion due to electrical potential differences developed when the well casing extends through different underground formations or strata with varying electrical conductivities. The different formations generally each contain different salt and water concentrations, and therefore different potential differences are developed between any two sections of casing in contact with two different formations. Electrons leave one of these sections, rendering this section anodic, flow through the casing and collect on the other of the sections, rendering this second section cathodic. Positive hydrogen ions complete the circuit by gathering on the cathodic area through the formation.

As the electrons flow through the casing, an electrochemical process causes hydrogen atoms to form in the cathodic area and iron from the casing to dissolve in the anodic area. The iron is dissolved by the formation of iron ions. The hydrogen formed in the cathodic area is removed by reaction with oxygen to form water or by the action of hydrogen consuming bacteria.

If the electron flow is permitted to continue, enough iron will be removed from the casing to corrode the casing and eventually cause leaks to develop.

Conventionally, this electrochemical corrosion in the anode area is prevented by connecting the negative terminal of a direct current source to the casing and connecting the positive terminal of the source to an anode buried in the earth adjacent to the well. If the direct current is appropriately applied, all points along the length of the casing will be cathodic with respect to the buried anode, the electrons will flow from the anode to the casing through the metallic path, and no corrosion of the casing occurs.

In order to apply the direct current appropriately, however, it is important to know which areas of the well casing are cathodic and which are anodic, and by how much. It is the usual practice to apply the cathodic protection current to the deepest anodic region, but if one section of the casing is particularly anodic due to the particular nature of the underground formation of its environment, the application of direct current can be made more accurately. In the absence of this type of information, current may be applied in insufficient strength or where it is not needed.

In the prior art, the identification of cathodic and anodic areas has been made on the well casing after the well has been drilled and the casing is in place using a specialized Cathodic Protection Evaluation Tool (CPET) that is moveable along the casing to measure the potential and generate a CPET log. Unfortunately, these logs are expensive, costing approximately $10,000 per log.

The conventional practice has therefore been to do only one CPET log at each new field, in either a static or polarized run, and to try to generalize the data gathered from that log to all wells in the same field. A static CPET log run is conducted to determine if corrosion is taking place so that cathodic protection is needed and if so, how much. A polarized CPET log run is conducted by first applying cathodic protection for a few weeks to fully polarize the casing and then running the polarized CPET log to determine whether the applied cathodic protection has actually provided adequate protection to the casing down through the corrosive zone, in an attempt to optimize the CP system current output.

However, the conventional method of trying to generalize the CPET log data from one well to the entire field has not proven to be sufficiently accurate in determining the correct amount and depth of application of cathodic protection current. While this method provides useful information, it is clearly not an optimized solution.

OBJECTS AND SUMMARY OF THE INVENTION

It is therefore an object of the present invention to provide a method of identifying the anodic and cathodic areas along a well casing that avoids the above-described difficulties of the prior art.

It is a further object of the present invention to provide a method of identifying the anodic and cathodic areas along the well casings of a number of wells that does not require a separate CPET log for each well.

It is another object of the present invention to provide a method of identifying anodic and cathodic areas along a well casing that avoids the expense and difficulty of the prior art.

It is yet another object of the present invention to provide a method of identifying the anodic and cathodic areas along a well casing that is performed at the time of the drilling of the well itself.

The above and other objects are achieved by the present invention which recognizes that information as to which areas of a well casing will be cathodic or anodic is in fact available from another source separate from the CPET logs, i.e. from the drill stem resistances measurable as the well itself is being drilled. The drill stem resistances can be correlated to the types of soil in the different underground formations through which the drilling is passing, for example by using a single CPET log for one of the plurality of wells to be drilled in the same field, and this in turn identifies which well casing sections, when inserted into the different types of soil, will be relatively cathodic or anodic and to what extent. Thereafter, when the next well is drilled in this field and its drill stem resistances are measured, it is possible to identify the different underground formations through which the second casing will pass, and from this information to predict which portions of the second casing will be anodic or cathodic.

Thus, in accordance with the present invention, the first well in a new field may be drilled and the casing put in place, with the drill stem data being collected during drilling. Then a one-time CPET log run is conducted for this well, and the CPET findings are compared to and matched with the findings from the drill stem data to confirm the identification of the cathodic and anodic zones for casings in the underground formations. Subsequently, as additional wells are drilled in this field, the cathodic and anodic regions of their well casings can be determined from their drill stem data alone, without a separate CPET for each additional well. The collection of the drill stem data is much easier and less expensive than running a CPET, and therefore the method in accordance with the present invention provides substantial advantages over the prior art.

Accordingly, in one preferred embodiment, the present invention is directed to a method of well casing cathodic current optimization for application of cathodic current to an underground well casing in a field intended to have at least a first well. The method comprises the steps of measuring drill stem resistances along a well hole for the first well, correlating the drill stem resistances to respective types of underground formations having respective resistivity conditions at corresponding positions along the well hole, predicting, in accordance with the correlating step, a position of at least one anodic area on a well casing to be installed in the well hole due to the resistivity conditions of the types of underground formations that will be in electrical contact with the well casing when installed, and determining, in accordance with the predicting step, at least one application position on the well casing and an amount of cathodic current to be applied to each application position to avoid corrosion of the well casing when installed.

In accordance with another preferred embodiment, the present invention is directed to a method of well casing cathodic current optimization for application of cathodic current to an underground well casing in a field intended to have at least first and second wells. The method comprises the steps of measuring first drill stem resistances along a first well hole for the first well, correlating the first drill stem resistances to respective types of underground formations having respective resistivity conditions at corresponding positions along the first well hole to generate initial correspondence data, installing a first well casing in the first well hole, conducting a CPET log run on the installed first well casing to generate CPET log data, generating confirmed correspondence data based upon the initial correspondence data and the CPET log data, identifying, by using the confirmed correspondence data, a position of at least one first anodic area on the installed first well casing due to the resistivity conditions of the types of underground formations that are in electrical contact with the installed first well casing, determining, in accordance with the identifying step, at least one first application position on the first well casing and a first amount of cathodic current to be applied to each first application position to avoid corrosion of the first well casing, measuring second drill stem resistances along a second well hole for the second well, predicting, by using the second drill stem resistances and the confirmed correspondence data, a position of at least one second anodic area on a second well casing to be installed in the second well hole due to the resistivity conditions of the types of underground formations that will be in electrical contact with the second well casing when installed, and determining, in accordance with the predicting step, at least one second application position on the second well casing and a second amount of cathodic current to be applied to each second application position to avoid corrosion of the second well casing when installed.

In accordance with a further development, the method includes the additional steps of installing the well casings in the well holes and applying the respective amount of cathodic current to each application position of the installed well casings.

These and other objects, features and advantages of the present invention will be apparent from the following detailed description of the preferred embodiments taken in conjunction with the following drawings, wherein like reference numerals denote like elements.

DETAILED DESCRIPTION OF THE PREFERRED EMBODIMENT

Figure 1:
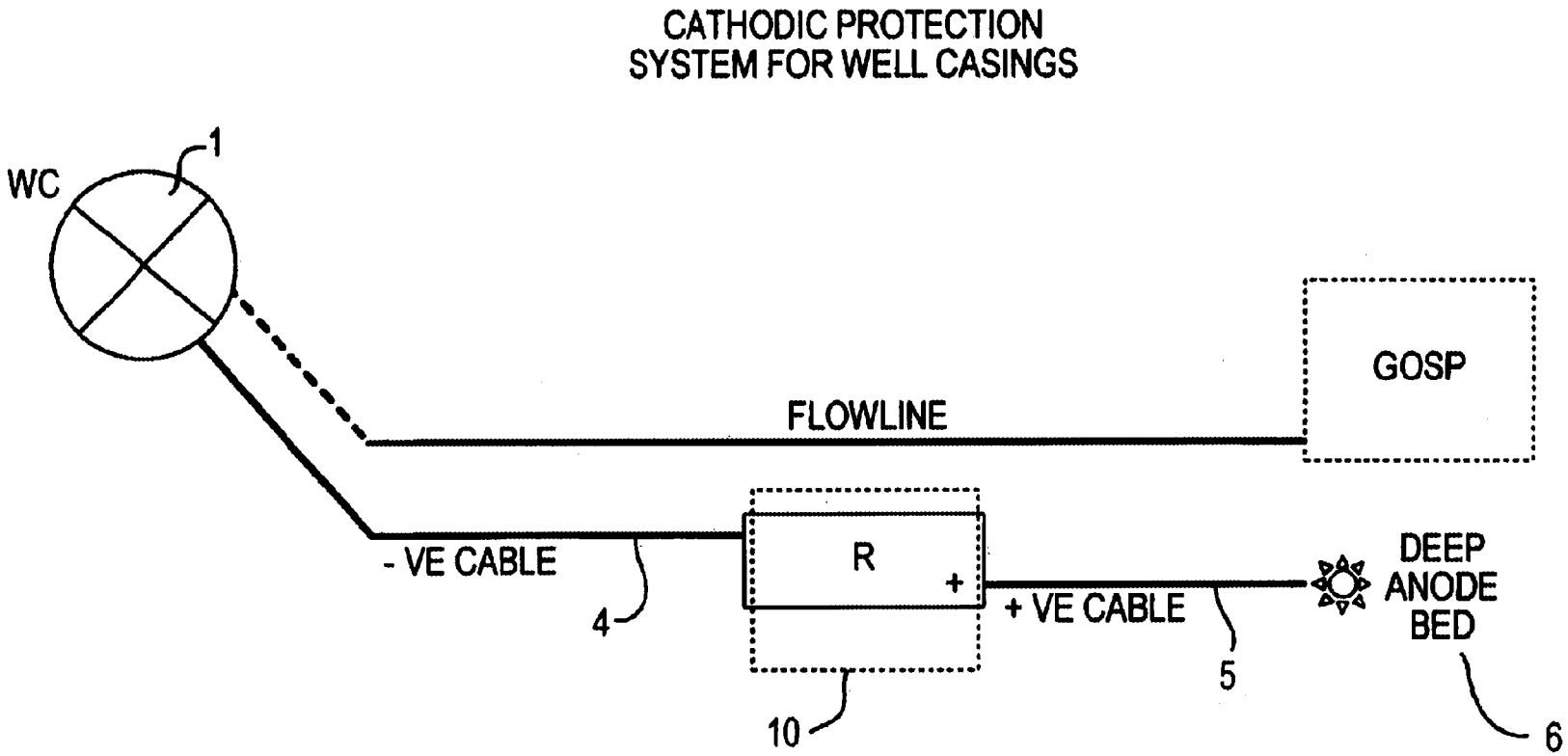
FIG. 1 is a schematic block diagram showing the connections of a system for measuring the drill stem resistances, and the corresponding connections for a cathodic protection system for applying cathodic current to a well casing.

FIG. 1 illustrates the application of cathodic current to a well casing 1. A rectifier 10 has its negative terminal connected through a negative cable 4 to the well casing 1 and its positive terminal connected through a positive cable 5 to the deep anode bed 6, which protects the casing 1.

To better protect the well casing 1 from corrosion, the method in accordance with a preferred embodiment of the present invention measures the drill stem data in order to determine the depth at which the negative cable 4 is to be connected to the well casing 1 as well as the amount of cathodic protection current to be applied. This is done for each well in the field.

The drill stem data for each well is advantageously collected for use in the present invention by first establishing a low resistance ground connection remote from the well and connecting it to one terminal of a two-pin resistance meter. Advantageously, the two-pin resistance meter may be a Nilsson 400® soil resistance meter, having four terminals C1, C2, P1, P2, with C1 shorted to P1 and C2 shorted to P2, effectively creating a two terminal meter. The other (combined) terminal of the meter is connected to the drill rig, i.e. the drill stem, so that the drill stem contact resistance can be measured at specific intervals, e.g. at every 10 meters. The values of this measured resistance versus depth are recorded while the well is being drilled.

Figure 2:
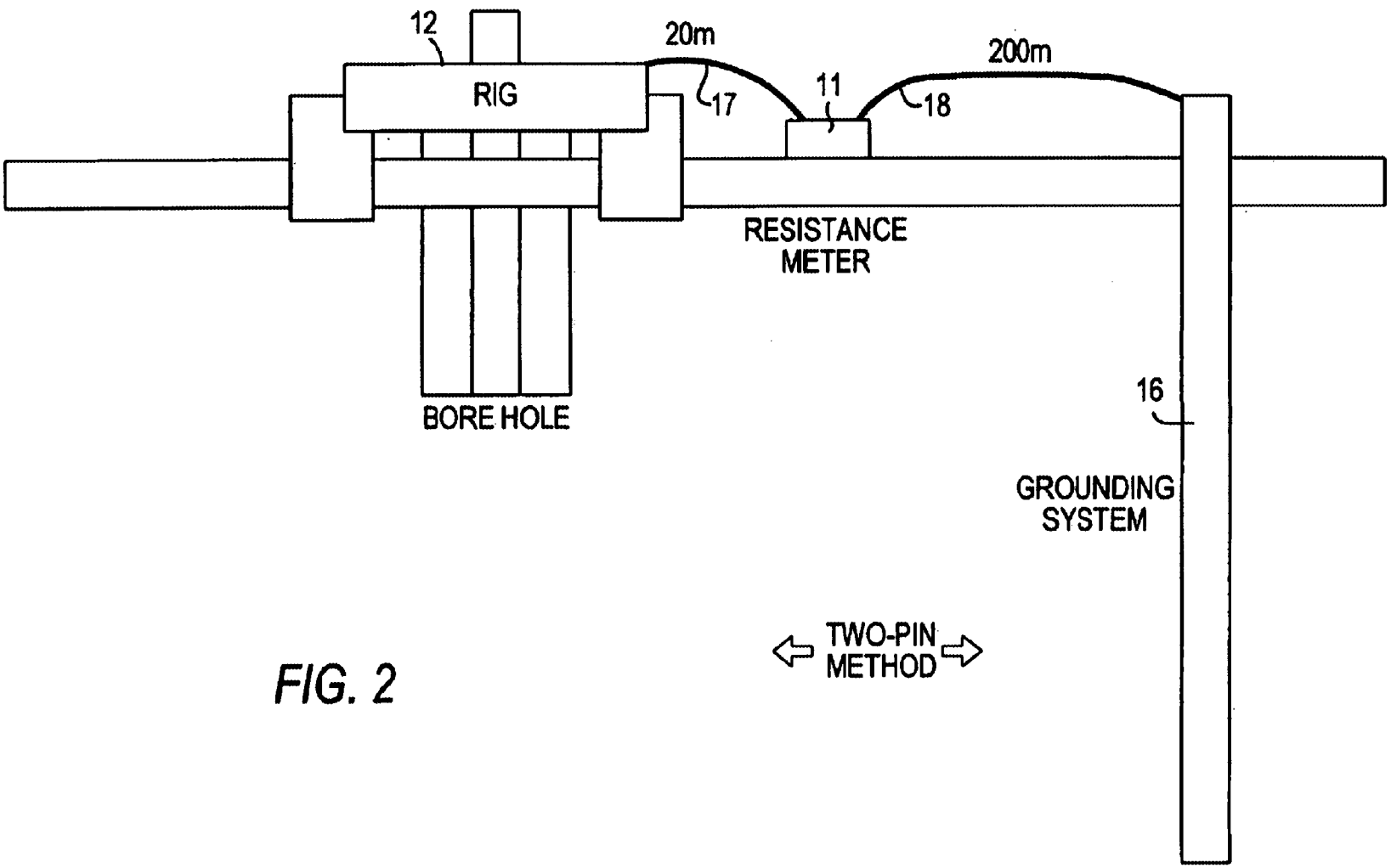
FIG. 2 is a schematic diagram of the connections of a resistance meter in a system for measuring drill stem resistances during drilling.

FIG. 2 illustrates the connections of such a resistance meter 11 in a system for measuring drill stem resistances during drilling using the two-pin method. As shown in FIG. 2, the measurement of the resistances advantageously takes place while the rig 12 is in the process of drilling the well or bore hole 14. As the rig 12 moves deeper into the ground, the resistance at each of a plurality of positions below ground level can be measured. The resistance meter 11 is connected to the rig 12 and to a grounding system 16.

Figure 3:
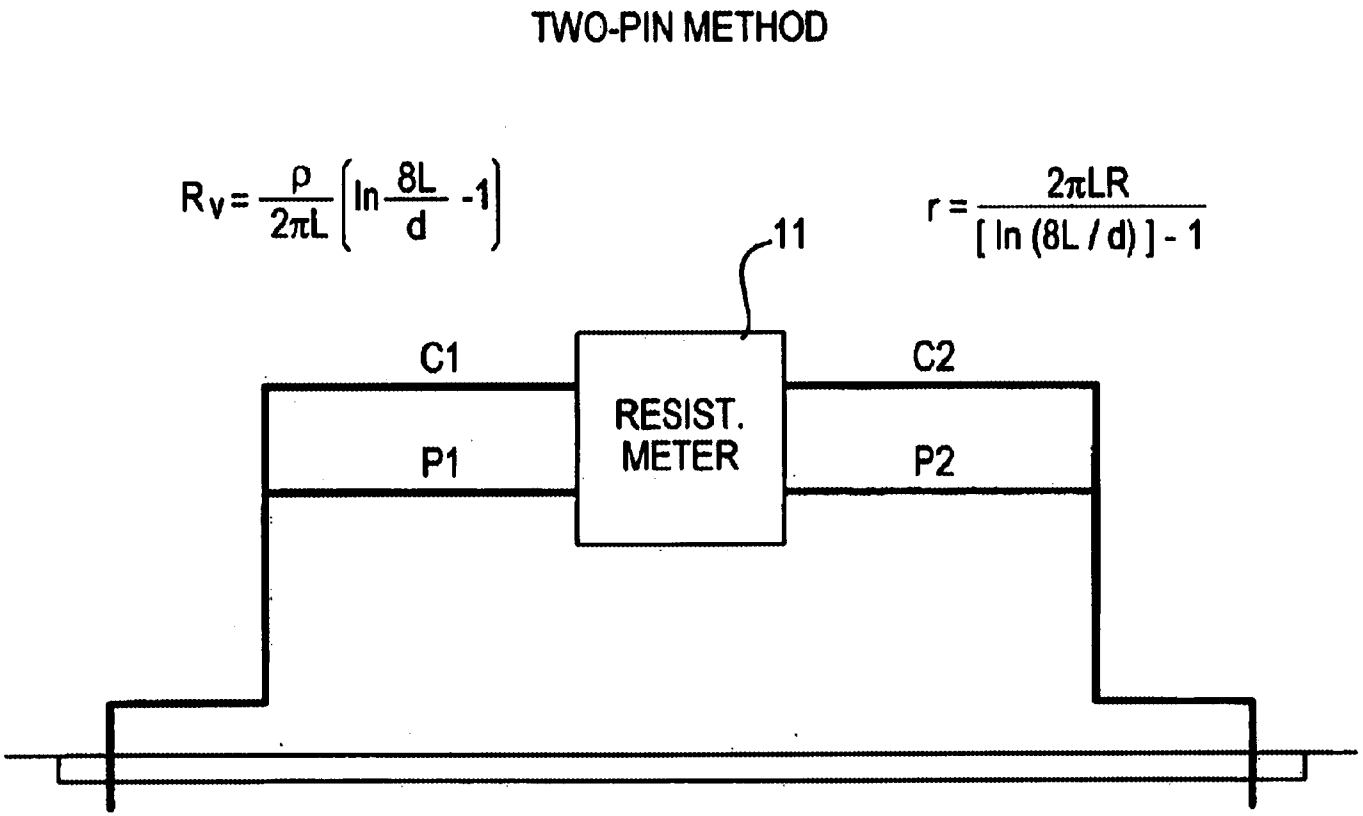
FIG. 3 is a diagram of the inputs to a resistance meter for measuring the drill stem resistance.

As shown in FIG. 3, the resistance meter 11 measures the drill stem resistance as a function of the four inputs C1, C2, P1 and P2, where C1=current injecting terminal C2=current receiving terminal P1=first potential sensing terminal P2=second potential sensing terminal.

Once the resistances are measured, they are converted to resistivities by the Dwight Equation:

$$R = \frac{\rho}{2\pi L}\{\ln(8L/d) - 1\}$$

where R=drill stem contact resistance to ground (ohm)

ρ=soil resistivity (ohm-cm)

$\pi$=constant=3.14

L=length of the drill stem pipe making contact with the ground (cm)

d=hole diameter (cm)

Solving for $\rho$ yields:

$$\rho=2\pi LR/\{\ln(8L/d)-1\}$$

Because the depth of the hole increases as drilling proceeds, the measured resistance will correspondingly decrease provided that the resistivity $\rho$ is constant. While the resistivity will change as the drill stem contacts different resistivity strata, the change in drill stem length is dominant over the average resistivity changes.

Thereafter, a plot of resistivities versus depth can be generated using, for example, the Barnes two-layer method. This is a well known and easy to use method, as demonstrated by the following example:

If the 20-meter and 10-meter resistivities are back calculated at 2400 and 2700 ohm-cm, respectively, then the Barnes 10- to 20-meter layer resistivity is:

$$P(\text{10- to 20-m layer})=(20-10)/((20/2700)-(10/2400))=2160 \text{ ohm-cm}$$

Once the first well in the new field is completed and the casing is in place, the one-time CPET log is run for this well in order to compare its findings with those of the drill stem data. Both the drill stem data graph of resistivity versus depth and the CPET log graph showing current versus depth should show the same anodic and cathodic zones. This is because where the drill stem resistivities are low, the strata conductivity is high. The CPET log will therefore show such an area as anodic, i.e. where the current leaves the casing to enter the formation, with the CPET log showing a negative slope (indicating corrosion).

Correspondingly, where the drill stem resistivities are high, the conductivities are low and the CPET log will show this area as cathodic by presenting a positive slope (protection), indicating that ionic current is collecting from the formation onto this section.

This procedure thereby first correlates the different types of underground formation having, e.g., different types of soil with corresponding drill stem resistances and then correlates the drill stem resistances with the cathodic and anodic zones. Therefore, for the subsequent wells drilled in this field, the drill stem resistances by themselves can be used to identify the cathodic and anodic zones on the casings.

The measurement of the drill stem resistances themselves is a relatively easy operation that can be automated to produce a measurement at every defined interval, e.g. 10 meters. This operation does not require sophisticated skills by the operator. Therefore, the use of these drill stem resistances to identify the anodic and cathodic zones makes it easy and inexpensive to optimize the cathodic protection system polarization current based upon the depth of the deepest corrosive zone in the same field.

This advantageous method in accordance with the present invention can be further generalized to interpret drill stem data gathered from wells in other fields and to identify the depth of the anodic zones. The CP current can then be optimized for these wells, eliminating as much as possible the need for expensive CPET logs.

Figure 4:
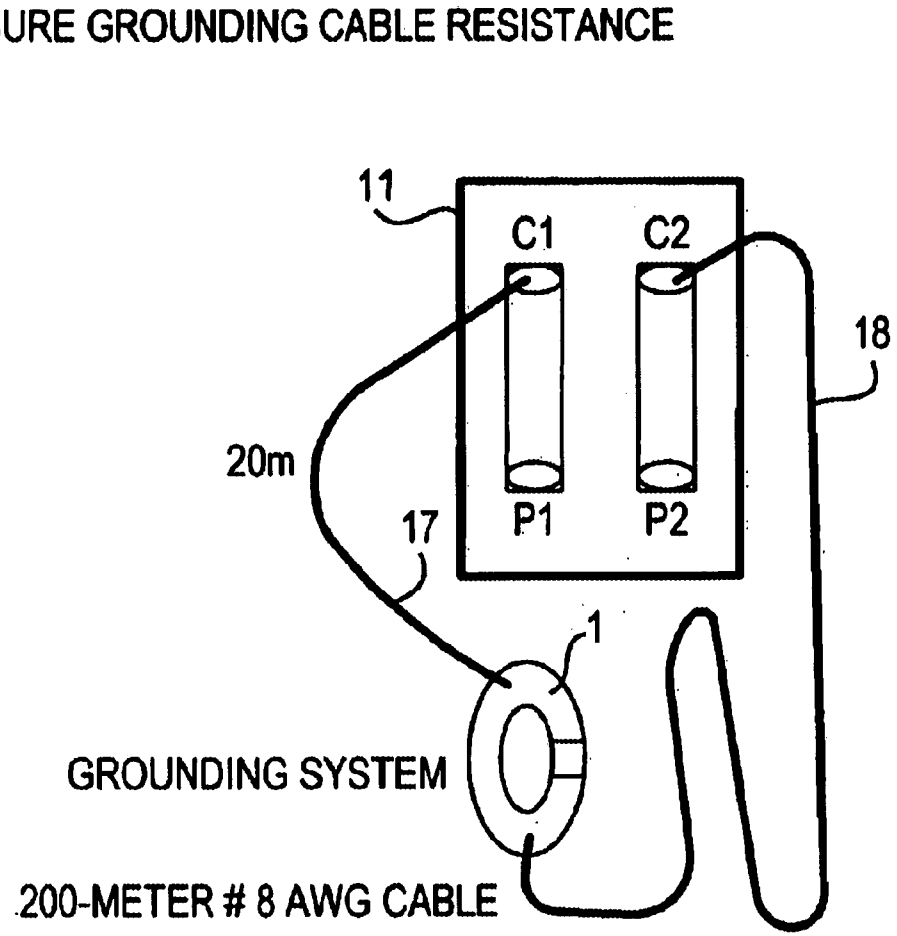
FIG. 4 is a diagram for demonstrating the measurement of the grounding cable resistance.

FIG. 4 illustrates the connections to the resistance meter 11 for measuring the grounding cable resistances 17 and 18 in an initial, calibrating step before the logging step in which the drill stem resistances are measured.

Figure 5:
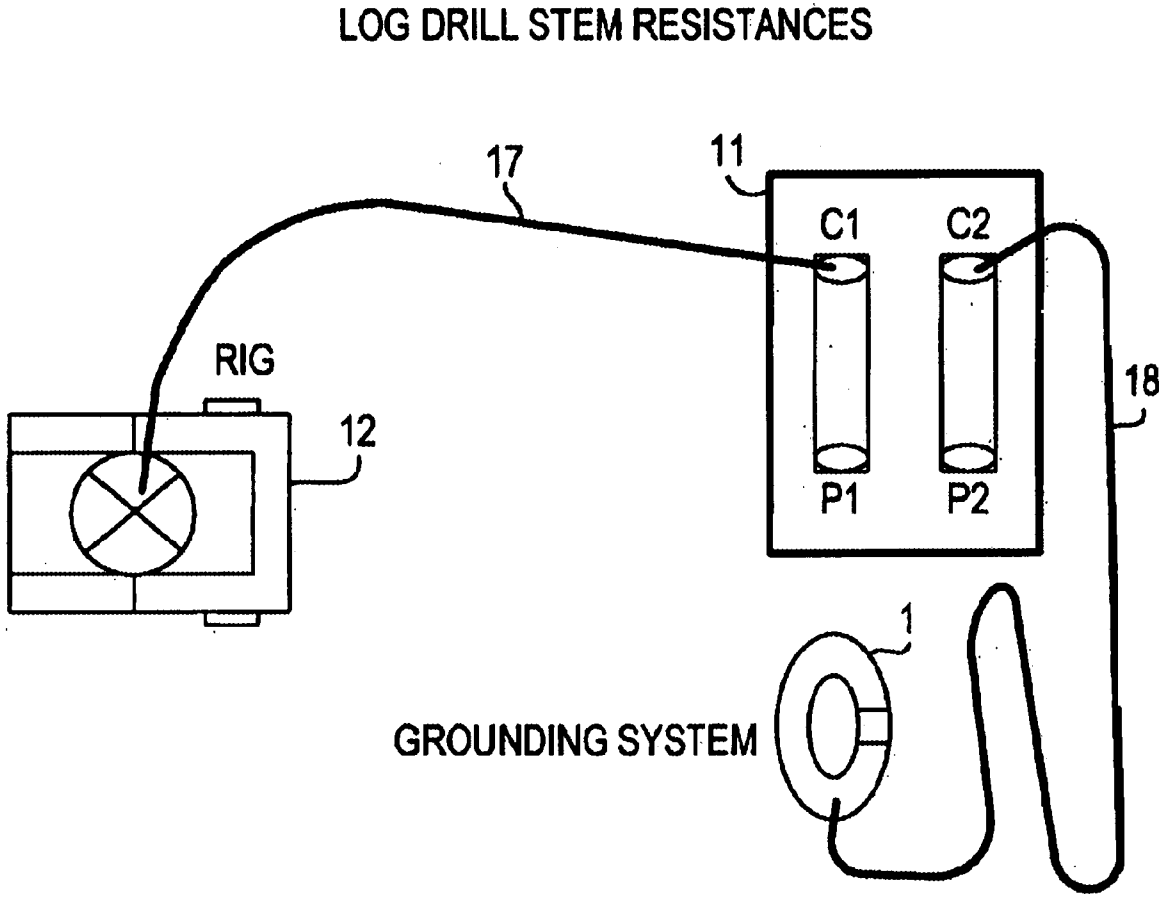
FIG. 5 is a diagram for demonstrating the logging step.

FIG. 5 illustrates the connections to the resistance meter 11 for the logging step, wherein the drill stem resistance is measured at depth intervals along the well casing 1.

In accordance with the present invention, each value of the measured resistance may be correlated with a type of soil. For example, a wet soil will have a different resistance from a dryer soil otherwise having the same constituents, and a soil containing a higher concentration of current carrying elements will have a different resistance from a relatively insulative soil.

Figure 6:
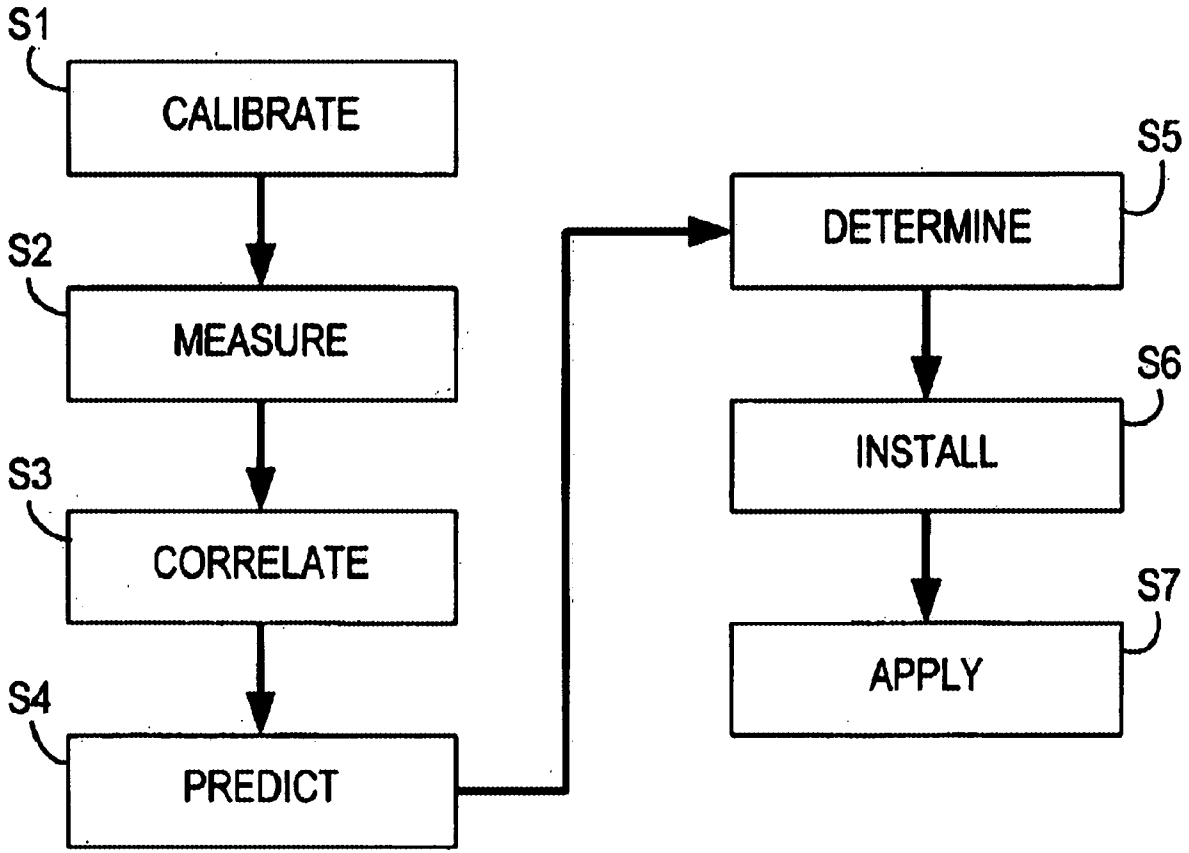
FIG. 6 is a flowchart of a method in accordance with the present invention.

FIG. 6 is a flowchart of a method in accordance with the present invention. In step S1, the measurement apparatus is calibrated, including measuring the grounding cable resistances. In step S2, the drill stem resistances are measured. In step S3, the measured resistances are correlated to respective types of soils. In step S4, the positions of the anodic areas are predicted. In step S5, the amounts of cathodic current to be applied are determined. In step S6, the well casing is installed, and in step S7, the cathodic currents are applied.

The use of at least one CPET for confirming the identification of the anodic and cathodic zones from the drill stem data is highly advantageous, but other methods for confirmation may be used, or the drill stem data may be used on its own.

Moreover, the drill stem resistances may be used in accordance with the present invention regardless of whether they are obtained during drilling or at any other time.

While the disclosed method has been particularly shown and described with respect to the preferred embodiments, it is understood by those skilled in the art that various modifications in form and detail may be made therein without departing from the scope and spirit of the invention. Accordingly, modifications such as those suggested above, but not limited thereto are to be considered within the scope of the invention, which is to be determined by reference to the appended claims.

I claim:

1. A method of well casing cathodic current optimization for application of cathodic current to an underground well casing in a field intended to have at least first and second wells, said method comprising the steps of:

measuring first drill stem resistances along a first well hole for the first well;

correlating the first drill stem resistances to respective types of underground formations having respective resistivity conditions at corresponding positions along the first well hole to generate initial correspondence data;

installing a first well casing in the first well hole;

conducting a CPET log run on the installed first well casing to generate CPET log data;

generating confirmed correspondence data based upon the initial correspondence data and the CPET log data;

identifying, by using the confirmed correspondence data, a position of at least one first anodic area on the installed first well casing due to the resistivity conditions of the types of underground formations that are in electrical contact with the installed first well casing;

determining, in accordance with said identifying step, at least one first application position on the first well casing and a first amount of cathodic current to be applied to each first application position to avoid corrosion of the first well casing;

measuring second drill stem resistances along a second well hole for the second well;

predicting, by using the second drill stem resistances and the confirmed correspondence data, a position of at least one second anodic area on a second well casing to be installed in the second well hole due to the resistivity conditions of the types of underground formations that will be in electrical contact with the second well casing when installed; and determining, in accordance with said predicting step, at least one second application position on the second well casing and a second amount of cathodic current to be applied to each second application position to avoid corrosion of the second well casing when installed.

2. The method of claim 1, further comprising the step of applying the respective first amount of cathodic current to each first application position of the installed first well casing.

3. The method of claim 1, further comprising the steps of:

installing the second well casing in the second well hole; and applying the respective second amount of cathodic current to each second application position of the installed second well casing.

4. The method of claim 1, wherein said measuring step uses a two-pin method of measuring drill stem resistances.

5. The method of claim 1, wherein said measuring step includes the step of logging drill stem resistances.

6. The method of claim 1, wherein said measuring step is automated.

7. A method of well casing cathodic current optimization for application of cathodic current to an underground well casing in a field intended to have at least a first well, said method comprising the steps of:

measuring drill stem resistances along a well hole for the first well utilizing a two-pin measurement method;

correlating the drill stem resistances to respective types of underground formations having respective resistivity conditions at corresponding positions along the well hole;

predicting, in accordance with said correlating step, a position of at least one anodic area on a well casing to be installed in the well hole due to the resistivity conditions of the types of underground formations that will be in electrical contact with the well casing when installed; and determining, in accordance with said predicting step, at least one application position on the well casing and an amount of cathodic current to be applied to each application position to avoid corrosion of the well casing when installed.

8. The method of claim 7, further comprising the step of applying the respective amount of cathodic current to each application position of the installed well casing.

9. The method of claim 7, wherein said measuring step includes the step of logging drill stem resistances.

10. The method of claim 7, wherein said measuring step is automated.

* * * * *